United States Patent [19]

Lipp

[11] 4,443,499

[45] Apr. 17, 1984

[54] METHOD OF MAKING A FOCUSING COLOR-SELECTION STRUCTURE FOR A CRT

[75] Inventor: Steven A. Lipp, Hopewell, N.J.

[73] Assignee: RCA Corporation, New York, N.Y.

[21] Appl. No.: 520,213

[22] Filed: Aug. 4, 1983

Related U.S. Application Data

[62] Division of Ser. No. 228,588, Jan. 26, 1981, Pat. No. 4,427,918.

[51] Int. Cl.[3] ..... B05D 1/36; B05D 5/00; B44C 1/22; C23F 1/02

[52] U.S. Cl. ..... 427/258; 29/163.5 R; 156/644; 156/651; 156/656; 156/661.1; 427/287; 427/405; 427/409; 427/259; 427/264; 427/265; 430/23; 430/316; 430/318; 445/47

[58] Field of Search ..... 430/23, 312, 313, 316, 430/318, 329; 156/644, 651, 656, 659.1, 661.1; 313/402, 403; 29/25.14, 25.17, 25.18; 427/243, 247, 258, 287, 404, 405, 407.1, 409, 419.2; 204/24

[56] References Cited

U.S. PATENT DOCUMENTS

| | | | |
|---|---|---|---|
| 3,196,043 | 7/1965 | Harris et al. | 427/247 X |
| 3,923,566 | 12/1975 | Law | 156/644 X |
| 4,059,781 | 11/1977 | van Alphen et al. | 313/403 |
| 4,107,569 | 8/1978 | Ronde | 313/402 |
| 4,112,563 | 9/1978 | Esdonk | 29/25.14 |
| 4,121,131 | 10/1978 | Esdonk et al. | 313/402 |
| 4,188,562 | 2/1980 | Oostrum | 313/402 |
| 4,207,656 | 6/1980 | Esdonk et al. | 29/25.14 |
| 4,222,159 | 9/1980 | Koorneef | 29/25.14 |

*Primary Examiner*—William A. Powell

*Attorney, Agent, or Firm*—E. M. Whitacre; D. H. Irlbeck; L. Greenspan

[57] ABSTRACT

The novel method comprises (1) producing in one major surface of a metal masking plate an array of substantially-parallel ridges separated by valleys or grooves, (2) removing metal from the other of said major surfaces in generally rectangular-shaped areas opposite the valleys and extending through the plate, (3) covering the tops of the ridges with an electrically-insulating first coating and (4) covering the first coating with an electrically-conducting second coating.

7 Claims, 12 Drawing Figures

Fig. 1
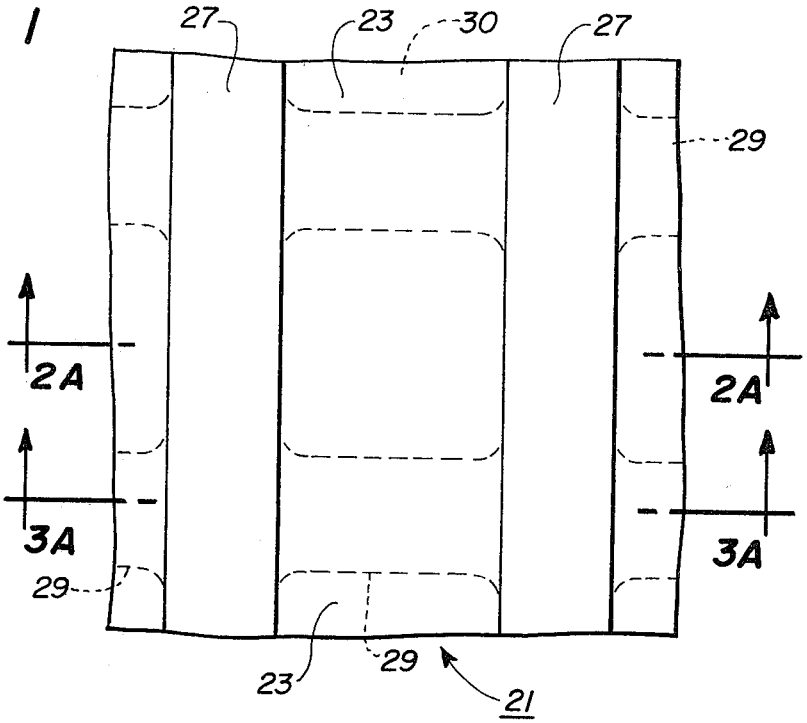
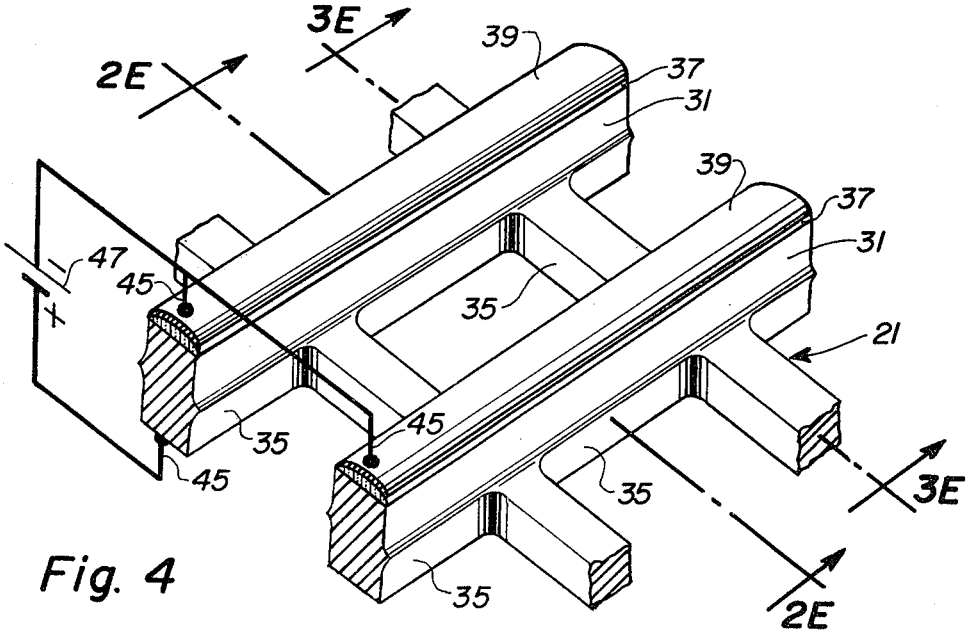
Fig. 4

METHOD OF MAKING A FOCUSING COLOR-SELECTION STRUCTURE FOR A CRT

This is a division of application Ser. No. 228,588, filed Jan. 26, 1981, now U.S. Pat. No. 4,427,918.

BACKGROUND OF THE INVENTION

This invention relates to a novel method of making a quadrupolar focusing color-selection structure for a CRT (cathode-ray tube).

A commercial shadow-mask-type color television picture tube, which is a CRT, comprises generally an evacuated envelope having therein a target comprising an array of phosphor elements of three different emission colors arranged in color groups in cyclic order, means for producing three convergent electron beams directed towards the target, and a color-selection structure including a masking plate between the target and the beam-producing means. The masking plate shadows the target, and the differences in convergence angles permit the transmitted portions of each beam, or beamlets, to select and excite phosphor elements of the desired emission color. At about the center of the color-selection structure, the masking plate of a commercial CRT intercepts all but about 18% of the beam current; that is, the plate is said to have a transmission of about 18%. Thus, the area of the apertures of the plate is about 18% of the area of the masking plate. Since there are no focusing fields present, a corresponding portion of the target is excited by the beamlets of each electron beam.

Several methods have been suggested for increasing the transmission of the masking plate without substantially increasing the excited portions of the target area. In one approach, each of the apertures of the color-selection structure is defined by a quadrupolar electrostatic lens which focuses the beamlets passing through the lens in one direction and defocuses them in another direction on the target depending upon the relative magnitudes and polarities of the electrostatic fields comprising the lens. In one type of quadrupolar-lens color-selection structure described, for example, in U.S. Pat. No. 4,059,781 to W. M. Van Alphen et al., a strong focusing quadrupolar lens is generated from voltages applied between an apertured masking plate and an array of conducting strips which are disposed between columns of the apertures and are insulatingly spaced from one major surface of the plate. In a typical color-selection structure of this type, the apertures may be about 0.56 mm (22 mils) wide on about 0.76 mm (30 mils) centers horizontally and 0.56 mm (22 mils) high on about 0.76 mm (30 mils) centers vertically, and the conducting strips may be about 0.20 mm (8 mils) wide and spaced about 0.05 mm (2 mils) from the plate.

Because of the small and precise sizes required of the apertures and the strips, special techniques must be employed to fabricate structures of this type at reasonable cost. Several methods have been suggested previously. But, each prior method appears to be too costly and may not produce an adequate yield of acceptable structures.

SUMMARY OF THE INVENTION

The novel method comprises (a) providing a metal plate having two opposed major surfaces, (b) producing in one of the major surfaces an array of substantially-parallel ridges of plate metal separated by valleys or grooves therebetween, (c) removing metal from the other of said surfaces in shaped areas opposite said valleys and extending completely through said plate, thereby producing an array of shaped apertures through said plate, (d) covering selected surface portions of the tops of said ridges with a first coating of electrically-insulating material and (e) covering selected surface portions of said first coating with a second coating of electrically-conducting material, said second coating being spaced from said plate.

In the preferred embodiment of the novel method, relatively-narrow ridges, relatively-wide valleys and apertures are made at the same time by producing temporary stencils, as by a photographic technique, on both major surfaces, and then etching the plate through both stencils. Then, the electrically-insulating first coating may be rolled on the tops of the ridges, after which an electrically-conducting second coating is applied on top of the first coating.

BRIEF DESCRIPTION OF THE DRAWINGS

FIG. 1 is a plan view of a fragment of a metal plate having acid-resistant stencils on both major surfaces thereof during the practice of the novel method, one of the stencils having an array of substantially-rectangular openings therein.

FIG. 4 is a perspective view of a fragment of a color-selection structure prepared by the novel method.

DETAILED DESCRIPTION OF THE PREFERRED EMBODIMENTS

Figure 2A:
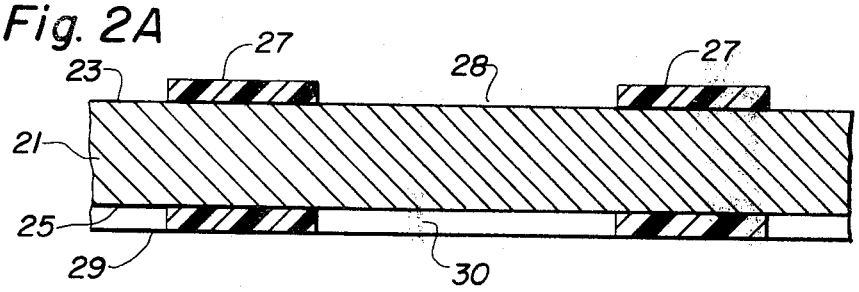
FIGS. 2A through 2E are a series of sectional elevational views along section line 2A—2A of the metal plate of FIG. 1 viewed through said openings during the fabrication into a color-selection structure according to the novel method.
Figure 2B:
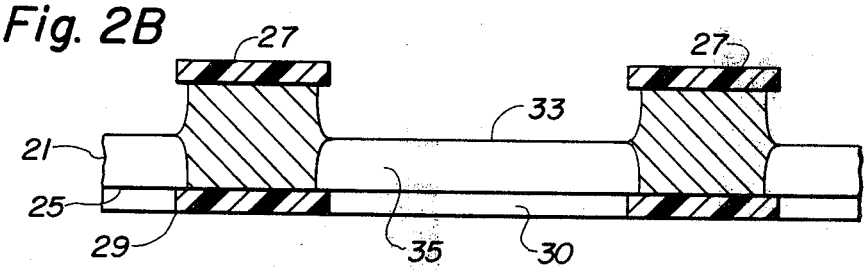
Figure 2C:
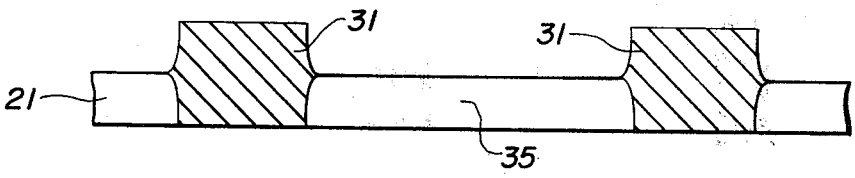
Figure 2D:
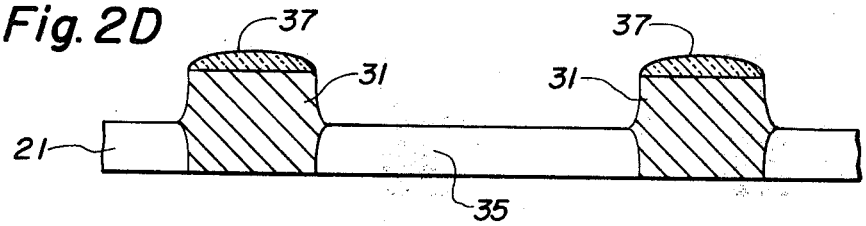
Figure 2E:
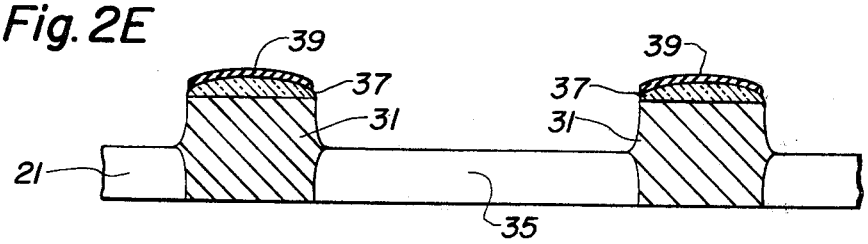
Figure 3A:
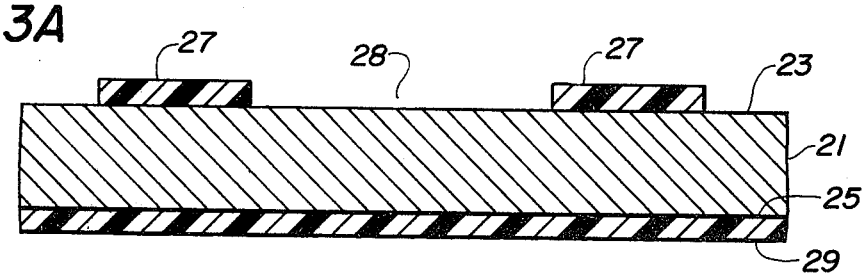
FIGS. 3A through 3E are a series of sectional elevational views along section line 3A—3A of the metal plate of FIG. 1 viewed between said openings during the fabrication into a color-selection structure according to the novel method.

The novel method is illustrated by the sequence of steps shown in FIGS. 2A through 2E and 3A through 3E. The first step includes providing a metal sheet or plate 21 having two opposed major surfaces 23 and 25 as shown in FIGS. 1, 2A and 3A. An upper acid-resistant stencil 27 is produced on the upper surface 23, and a lower acid-resistant stencil 29 is produced on the lower surface 25.

The upper stencil 27 consists essentially of relatively-narrow, substantially-parallel, acid-resistant stripes separated by relatively-wide open areas 28 (which expose the upper surface 23). The lower stencil 29 consists essentially of a coating of acid-resistant material having therein an array of substantially-rectangular open areas 30 (which expose the lower surface 25) arranged in substantially-parallel columns which are opposite the open areas of the first stencil 27.

FIG. 2A is a sectional view of the structure shown in FIG. 1 along section lines 2A—2A across the stripes of the first stencil 27 and through the open areas of the second stencil 29. FIG. 3A is a sectional view of the structure shown in FIG. 1 along section lines 3A—3A across the stripes of the first stencil 27 and between two adjacent open areas of the second stencil 29.

The metal plate 21 is preferably about 0.15 mm (6 mils) thick, although other thicknesses may be used. The plate 21 is of low-carbon cold rolled steel. Other metals or metal alloys, such as a copper alloy containing about 2-weight-percent beryllium and known as Berylco 25, may be used. The stencils 27 and 29 are prepared by a photographic technique using a photoresist. Although any photoresist may be used, the photoresist used in this example is dichromate-sensitized casein. Alternatively, the photoresist may be a precast sheet marketed under the name Riston 210R by E. I. du Pont, Wilmington, Del. Each photoresist sheet is sandwiched between a sheet of mylar and a sheet of polyethylene. In use the polyethylene sheet is stripped off, and then a photoresist sheet is laminated to each major surface 23 and 25 respectively with the mylar sheets covering the photoresist sheets or layers.

Each of the photoresist layers 27 and 29 is exposed to an image of actinic radiation, as by contact exposure through a template or photographic working plate, whereby there are produced in each layer regions which are more soluble and regions which are less soluble in a particular developer. The photoresist layers 27 and 29 in this example, being negative acting, are insolubilized by the exposing actinic light.

Next, photoresist layers 27 and 29 on both major surfaces of the plate 21 are developed, leaving a first upper stencil 27 having ridge-defining strips therein separated by open areas 28 and a second lower stencil 29 having therein aperture-defining open areas 30 opposite the open areas of the upper stencil 27. The preferred developer for a casein photoresist is water. Where the photoresist is Riston, the preferred developer is an aqueous liquid marketed under the name Riston II Developer 2000 by E. I. du Pont, Wilmington, Del. The ridge-defining strips of the upper stencil 27 are about 0.20 mm (8 mils) wide on about 0.76 mm (30 mils) centers and extend about the length of the plate 21.

Figure 3B:
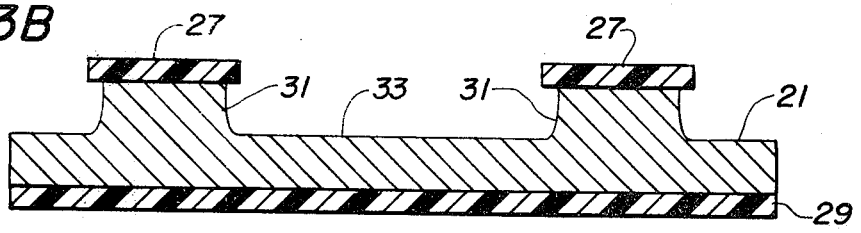

Next, as shown in FIGS. 2B and 3B, the metal plate 21 is etched by applying a suitable etchant through the open areas 28 and 30 of both the upper and lower stencils 27 and 29 to produce an array of substantially-parallel relatively-narrow ridges 31 about 0.10 mm (4 mils) high and relatively-wide valleys or grooves 33 in the upper surface 23 of the plate and an array of substantially-rectangular apertures 35 through the plate 21 into the grooves 33. The preferred etchant is aqueous 50-weight-percent ferric chloride solution containing hydrochloric acid. After the grooves 33 and apertures 35 are etched, the external surfaces of the plate 21 are rinsed with deionized water to remove any residual etchant thereon.

Figure 3C:
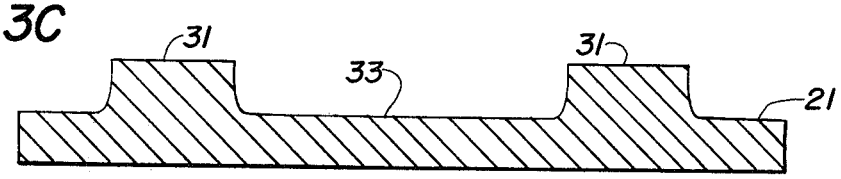

Next, as shown in FIGS. 2C and 3C, both the upper and lower stencils 27 and 29 are removed by any of the methods known in the art. Where a casein photoresist is used, it is preferred to apply a hot aqueous alkali solution to the stencils to solubilize them.

Figure 3D:
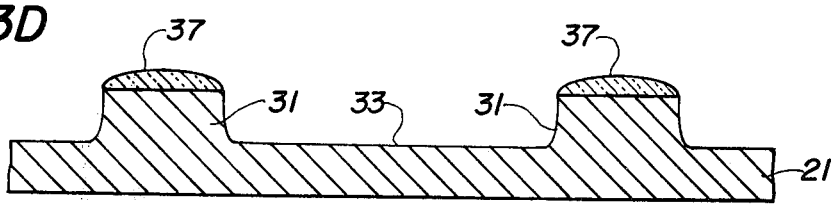

Next, as shown in FIGS. 2D and 3D, the tops of the ridges 31 are coated with electrically-insulating material. Inorganic material or organic polymeric material which can tolerate subsequent processing can be used. In this example, a polyimide, such as Pyralin PI 2550 marketed by E. I. du Pont, Wilmington, Del., is rolled on the tops of the ridges 31 producing an insulating coating 37. Finely-divided silica, alumina or glass may be added to the polyimide to alter its coating characteristics. The desired thickness of electrically-insulating material may be built up by successive applications.

Figure 3E:
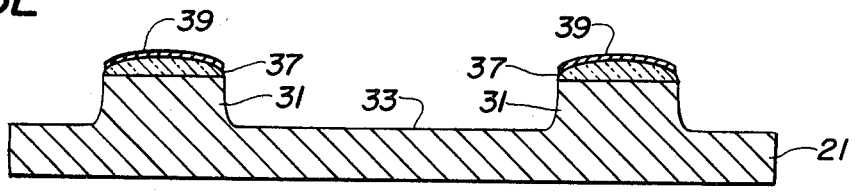

Next, as shown in FIGS. 2E and 3E, a coating 39 of an electrically-conducting material is applied on top of the electrically-insulating coating 37. The preferred material is a mixture of silver metal particles mixed with Pyralin, supra., which may be roller-coated on top of the insulating coating 37. Carbon, other metals or metal oxides may substitute for silver metal. Multiple applications may be used to build up the desired thickness. Alternatively, the tops of the ridges 45 may be metalized; that is, metal strips 53 may be deposited on the ridges and spaced from the metal plate 21. Metalization may be accomplished by vapor-deposition of a metal, such as aluminum, at low ambient pressures. In other alternatives, a conductive paste may be doctor-bladed over the ridges and then cured; or, the conductive strips can be cast over the ridges; or, prefabricated conductive metal strips may be transferred from a temporary substrate to the tops of the ridges.

The finished product is shown in the perspective view of a fragment thereof in FIG. 4. FIG. 2E is a sectional view of the structure shown in FIG. 4 viewed through the apertures along section line 2E—2E. FIG. 3E is a sectional view of the structure shown in FIG. 4 viewed between the apertures along sectional line 3E—3E. The color-selection structure comprises a metal masking plate 21 having an array of apertures 35 therethrough. The apertures 35 are arranged in substantially parallel columns, the spacing being related to the spacings of the luminescent strips of the viewing screen (not shown) of the CRT in which the structure is to be used. There is an array of substantially-parallel metal ridges 31 integral with and upstanding from one of the surfaces of the plate 21. The ridges are located between and substantially parallel to the columns of apertures 35. There is an electrically-insulating layer 37 on the tops of the ridges and an electrically-conducting layer 39 on top of the electrically-insulating layer 37.

The novel color-selection structure may be used in a color television picture tube substantially as described previously; for example, in Van Alphen et al., op. cit. To this end, the novel color-selection structure includes connections means 45 for applying a voltage from a voltage source 47 between the masking plate and the array of conductors. To obtain horizontal focusing and vertical defocusing, the masking plate 21 is electrically positive with respect to the array of conductors 39. Voltage differences between 200 and 1200 volts are practical provided the electrically-insulating layer 37 can withstand the electric field produced by this voltage difference.

I claim:

1. A method for making a quadrupolar focusing color-selection structure for a cathode-ray tube comprising A. providing a metal plate having two opposed major surfaces, B. producing in one of said surfaces an array of substantially-parallel ridges of plate metal spaced by valleys therebetween, said ridges having substantially flat tops, C. removing metal from the other of said surfaces from areas opposite said valleys and extending completely through said plate, thereby producing an array of shaped apertures through said plate, D. covering by roller coating selected surface portions of the tops of said ridges only with a first coating of electrically-insulating material, E. and covering selected surface portions of said first coating only with a second coating of electrically-conducting material, said second coating being spaced from said plate.

2. The method defined in claim 1 wherein, in step B, said ridges are relatively narrow and said valleys are relatively wide.

3. The method defined in claim 1 wherein step B comprises (i) producing a first etch-resistant stencil on said one major surface of said plate, said first stencil including therein substantially-parallel, strip-like, ridge-defining areas separated by strip-like open areas, (ii) etching said one major surface through said strip-like open areas (iii) and then removing said first stencil.

4. The method defined in claim 1 wherein step C comprises (i) producing a second etch-resistant stencil on the other major surface of said plate, said second stencil having therein open substantially-rectangular aperture-defining areas arranged in substantially parallel columns opposite said valleys, (ii) etching apertures through said plate by applying etchant at least through said aperture-defining areas of said second stencil (iii) and then removing said second stencil.

5. The method defined in claim 1 wherein step D comprises roller coating upon said surface portions successive layers of an electrically-insulating material consisting essentially of polyimide.

6. The method defined in claim 1 wherein step E comprises roller coating an electrical conductor on said first coating.

7. The method defined in claim 1 wherein the depths of said valleys and the heights of said ridges are at least twice the thickness of said plate under said valleys.

* * * * *